US006999920B1

(12) United States Patent
Matt et al.

(10) Patent No.: US 6,999,920 B1
(45) Date of Patent: Feb. 14, 2006

(54) EXPONENTIAL ECHO AND NOISE REDUCTION IN SILENCE INTERVALS

(75) Inventors: Hans-Jürgen Matt, Remseck (DE); Michael Walker, Baltmannsweiler (DE); Michael Maurer, Waiblingen (DE)

(73) Assignee: Alcatel, Paris (FR)

( * ) Notice: Subject to any disclaimer, the term of this patent is extended or adjusted under 35 U.S.C. 154(b) by 1064 days.

(21) Appl. No.: 09/716,272

(22) Filed: Nov. 21, 2000

(30) Foreign Application Priority Data

Nov. 27, 1999 (DE) ..... 199 57 221

(51) Int. Cl.
*G10L 11/06* (2006.01)

(52) U.S. Cl. ..... 704/215; 704/214; 704/209; 375/326; 381/104

(58) Field of Classification Search ..... 704/215, 704/226, 214, 209, 233, 265; 375/326; 381/104
See application file for complete search history.

(56) References Cited

U.S. PATENT DOCUMENTS

| | | | | |
|---|---|---|---|---|
| 4,374,302 A | * | 2/1983 | Vogten et al. | 704/265 |
| 4,630,304 A | * | 12/1986 | Borth et al. | 704/233 |
| 5,369,711 A | * | 11/1994 | Williamson, III | 381/104 |
| 6,549,587 B1 | * | 4/2003 | Li | 375/326 |

FOREIGN PATENT DOCUMENTS

| | | | |
|---|---|---|---|
| DE | 42 29 912 A1 | | 3/1994 |
| JP | 57-212831 | * | 12/1982 |
| JP | 04-082317 | * | 3/1992 |
| JP | 11-007306 | * | 1/1999 |

OTHER PUBLICATIONS

Martinez et al ("Implementation Of An Adaptive Noise Canceller On TMS320C31-50 for Non-Stationary Environments ", 13th International Conference on Digital Signal Processing Proceedings, Jul. 1997).*

Dehandschutter et al ("Real-Time Enhancement Of Reference Signals For Feedforward Control Of Random Noise Due To Multiple Uncorrelated Sources", IEEE Transactions on Signal Processing, Jan. 1998).*

"A new approach to noise reduction based on auditory masking effects" by S. Gustafsson and P. Jax, ITG Technical Conference, Dresden, 1998.

"A novel psychoacoustically motivated audio enhancement algorithm preserving background noise characteristics" by S. Gustafsson, P. Jax, and P. Vary, ITG Technical Conference, Dresden, 1998.

* cited by examiner

*Primary Examiner*—Vijay B. Chawan
(74) *Attorney, Agent, or Firm*—Sughrue Mion, PLLC

(57) ABSTRACT

Method for the reduction of echo and/or noise signals in TK systems for the transmission of useful acoustic signals, in which, when a silence interval is present, the distorted useful signal is modified by a time-dependent control signal $a_o(t)$ or by a control signal $a_o(k)$ cycled in the rhythm of a scan rate $f_T=1/T$. The control signal $a_o(k)$ is varied in such manner that, during the presence of speech signals in the useful signals, the amplitude of the control signal $a_o(k)$ is set to a predetermined constant value $c_o$ and, when a silence interval begins, the amplitude of the control signal $a_o(k)$ is reduced continuously from one sample value to the next in accordance with the recurrence formula $a_o(k+1)=a_o(k).\beta$ with $\beta<1$. After the end of the silence interval, $a_o(k)$ is again set equal to $c_o$.

31 Claims, 3 Drawing Sheets

EXPONENTIAL ECHO AND NOISE REDUCTION IN SILENCE INTERVALS

BACKGROUND OF THE INVENTION

A method of reducing echo and/or noise signals in telecommunications systems for transmitting useful acoustic signals, particularly human speech, comprising determining by silence detection when the mixture of useful signals and interference signals contains a speech signal or when a silence interval is present, and varying, by means of a two-input multiplier, the amplitude of the useful signals, which are generally disturbed by echo and/or noise signals, in response to a time-dependent control signal $a_0(t)$ or a control signal $a_0(k)$ clocked at a sampling rate $f_T=1/T$, where $k \in \aleph$ denotes the number of samples, and T denotes the period from one sample to the next.

Such a method is known, for example from DE 42 29 912 A1.

During natural communication between people, as a rule the amplitude of the spoken word is automatically adapted to the acoustic environment.

However in remote spoken communication the speaking partners are not in the same acoustic environment, so neither is aware of the acoustical situation at the location of the other. The problem occurs particularly acutely when one of the partners is compelled by his acoustic surroundings to speak very loudly, while the other partner is in a quiet acoustic environment and is producing speech signals of lower amplitude.

A further problem is that on a TK channel some noise of "electronic origin" is produced and this is co-transmitted as a background to the useful signal. Furthermore, it is also advantageous to attenuate or completely suppress distorting signals such as undesired background noise (noise from the street, the factory, the office, the canteen, aircraft noise, etc.). To enhance comfort while telephoning, it is generally attempted to keep every type of noise as low as possible.

Finally, in TK communications there also occur so-called echoes, which are present in two-wire TK networks as line echoes and can for example appear in simple and less comfortable TK terminals in the form of acoustical echoes.

In general therefore, in the transmission of a mixture of speech signals and distorting signals, it is important to reduce the amplitude of distorting signals such as noise and echoes as much as possible.

A known method for noise reduction is the so-called "spectral subtraction", as described for example in the publication "A new approach to noise reduction based on auditory masking effects" by S. Gustafsson and P. Jax, ITG Technical Conference, Dresden, 1998. This involves a spectral noise-reduction method in which an acoustic masking threshold (for example according to the MPEG Standard) is taken into account. The disadvantages of such methods are that determination of the said acoustic masking threshold is an elaborate process and that carrying out all the operations associated with the method entails considerable computational effort.

In spectral subtraction the noise in speech pauses is first measured and stored continuously in a memory in the form of a power density spectrum. The power density spectrum is obtained via a Fourier transformation. When speech occurs, the stored noise spectrum is subtracted as a "best current estimated value" from the actual distorted speech spectrum and then back-transformed in the same time area, so that in this way a noise reduction for the distorted signal is obtained.

A further disadvantage of spectral subtraction is that by virtue of the process of noise estimation and subsequent subtraction which are inexact in principle, defects occur in the output signal which are noticeable as "musical tones". In addition, this known method is hardly appropriate for the suppression of echo signals in TK communication links.

In the extended spectral signal processing also described in the reference cited above, with the help of spectral subtraction the power density spectra for the noise and for the speech itself are first estimated. From a knowledge of these part-spectra, with the help for example of the rules of the MPEG Standard, a spectral acoustic masking threshold $R_T(f)$ for the human ear is then calculated. With the help of this masking threshold and the estimated spectra for noise and speech, a simple rule is then applied to compute a filter pass curve H(f) which is designed such that essential spectral portions of the speech are let through as unchanged as possible, while spectral portions of the noise are attenuated as much as possible.

The original distorted speech signal then need only be passed through this filter to obtain a noise reduction for the distorted signal. The advantage of the method is now that "nothing is added to or subtracted from" the distorted signal, so estimation errors have little perceptible effect or hardly any at all. The disadvantages are again the considerable computational effort for spectral noise suppression and the need for upstream connection of an adaptive filter for echo suppression.

In the known compander method, as described for example in the patent DE42 29 912 A1 cited earlier, the degree of noise and echo attenuation is established in accordance with a fixed predetermined transfer function which, among other things, effects a level reduction even in the case of very small input signals.

The compander first has the property of transmitting speech signals with a given (previously set) "normal speech signal level" (sometimes called the normal loudness) virtually unchanged from its input to the output.

If, now, the input signal is ever too loud, for example because a speaker comes too close to his microphone, a dynamic compressor limits the output level to almost the same value as in the normal case, in that the actual amplification in the compander is linearly reduced as the input signal becomes louder. Thanks to this property, the speech at the output of the compander system remains at approximately equal loudness regardless of how marked is the fluctuation of the input loudness.

On the other hand, if a signal with a level lower than normal is fed to the input of the compander, the signal is additionally damped in that the amplification is cut back so as to transmit background noise only in attenuated form so far as possible.

Thus, the compander consists of a compressor for speech signal levels higher than or equal to a normal level, and an expander for signal levels lower than the normal level. In this, the amplification reduction in the expander is more marked the lower is the input level.

A disadvantage of the compander solution is the considerable computational effort required to carry out the known process. Besides, the compression of the speech signal level on the one hand and its expansion on the other hand give rise to a modulation in the loudness of the speech, which changes the speech signal in such a way that the result is often perceived subjectively as unsatisfactory, i.e. it creates an unsatisfactory auditory impression.

SUMMARY OF THE INVENTION

The purpose of the present invention, in contrast, is to propose a method having the characteristics described at the start, by means of which, in the least elaborate and most cost-effective way possible and without major computational effort and reduced need for computer memory and data storage space, echo and noise attenuation is achieved by using simple means to produce an overall acoustic impression as pleasant as possible for the human ear, which can in addition be adapted to individual needs according to taste.

According to the invention this objective is achieved in a manner as simple as it is effective, by varying the control signal $a_o(t)$ or $a_o(k)$ in such a way that during the presence of speech signals in the useful signal the amplitude of the control signal $a_o(t)$ or $a_o(k)$ is set to a predetermined constant amplification value $c_o$ and when a silence interval begins in the useful signal the amplitude of the control signal $a_o(t)$ or $a_o(k)$ is continually reduced from one sample value to the next in accordance with the recurrence formula:

$$a_o(k+1)=a_o(k).\beta \text{ where } \beta<1$$

and after the end of a silence interval $a_o(k)$ is again restored to $c_o$.

BRIEF DESCRIPTION OF THE DRAWINGS

The invention will be more clearly understood from the following detailed description n conjunction with the accompanying drawings, wherein.

DETAILED DESCRIPTION OF THE INVENTION

Figure 1:
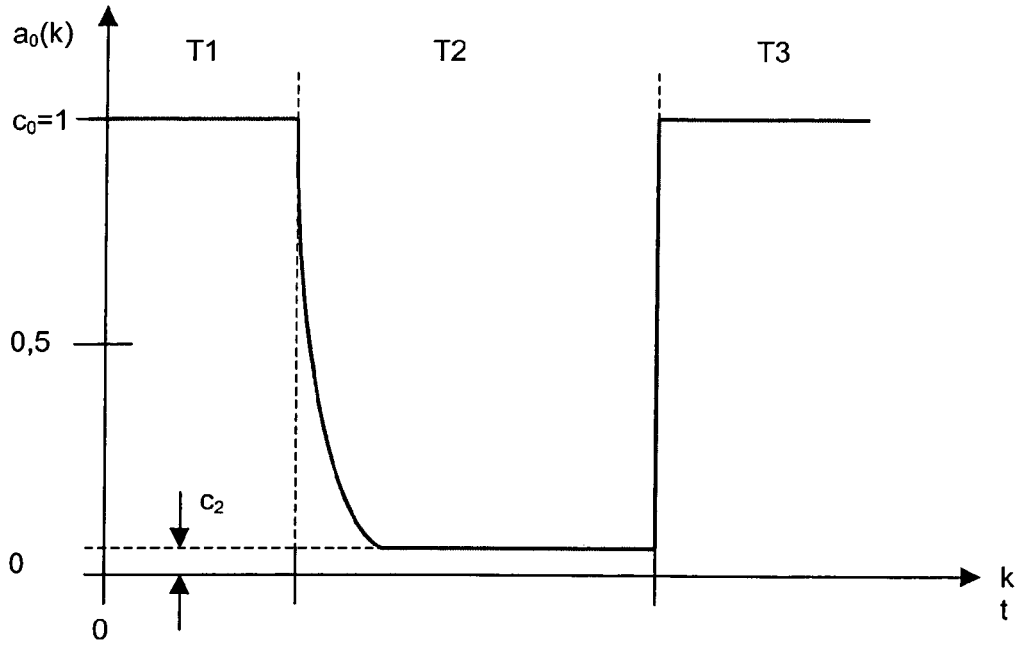
FIG. 1 shows the control signal $a_o$ in the presence of speech signals, during a silence interval, and when the speech signal resumes.

This provides a very simple and cost-effective method, which also achieves surprisingly good quality in relation to the reduction of distortion since it preferably attenuates the distorting echo and noise signals during silence intervals. During the speaking phases themselves, the distorting noise is at least partially masked and therefore obviously perceived by the human ear to a far smaller extent. By doing without compression according to the known compander method, the original speech signal is considerably less changed so that, as a result, a speech signal which as a rule sounds better at the other end of the line is obtained. In addition, the method according to the invention requires less computing power than the compander method, since at least the compression is omitted. Correspondingly, smaller capacities are needed for data storage and computer memory, and compared with the known method this makes the method according to the invention both simpler and cheaper.

To achieve effective noise attenuation, during silence intervals the power of the signal to be transmitted is reduced in accordance with a time-exponential function, in contrast to a reduction that depends on the input level as in the compander method. This already achieves appreciable noise attenuation, and in addition a reduction of noise during a silence interval is clearly less stressful for the hearing since it considerably reduces the deafening effect that occurs after loud noise. When speech is resumed the ear can react more sensitively and listen more accurately.

Advantageously, the factor $\beta$ is chosen such that the continuous time reduction corresponds approximately to a time constant $\tau_1$ of the perceptiveness of the human ear. This means that after a powerful noise stimulus, the human ear does not perceive new noise stimuli after the end of the powerful sound stimulus which are in time and amplitude below a variation curve that attenuates with time constant $\tau_1$. A variant of the method according to the invention is therefore preferred, in which the factor $\beta$ is determined from the sampling rate $f_T$, a time constant $\tau_1$, and a predefined constant factor $c_1$, according to the relation $\beta=c_1\cdot\exp(-1/\tau_1 f_T)$.

In man, the time constant $\tau_1$ is chosen to be between 50 ms and 150 ms, preferably $\tau_1\approx 65$ ms.

To dimension the factor $\beta$ accurately in accordance with the time constant $\tau_1$, it is best to choose $c_o=1$.

If the continuous exponential attenuation of the distortion signal according to the aforesaid recurrence formula is not limited, the value of $a_o(k)$ will very rapidly become fairly small as k increases, approaching zero. This, however, is not always desired since in many cases people like to hear a low level of residual noise so that during a speech pause the impression will be avoided that the TK line has suddenly "gone dead" or been interrupted. It is therefore preferable to have a variant of the method according to the invention in which during a silence interval and/or in the presence of an echo signal $a_0(k+1)$ assumes a predefined constant value $C_2$ if the preceding value $a_0(k)$ has become less than or equal to $c_2$.

Further, it is desirable to adapt the degree of signal level reduction during silence intervals to the momentary situation in the TK channel.

For example, noise can preferably be reduced as a function of the momentary noise level N or in a way that depends on a function g(S/N) of the signal-to-noise difference S/N, but short-time echoes can be reduced more strongly and, after the end of the echo, the reduction can be restored to the lesser value used for noise reduction.

It is therefore particularly preferable to apply a method variant characterised in that during a silence interval and/or in the presence of an echo signal and for $a_0(k)\leqq C_2$, where $C_2$ is a predefined constant, the power value of the noise level N in the communications channel currently being used is continuously measured and/or estimated, and that depending on the current noise level N, the control signal $a_0(k+1)$ is continuously adjusted according to $a_0(k+1)=f(N)$, where f(N) is a predetermined function of N.

In this way the degree of noise attenuation is automatically controlled as a function of the power N of the noise actually occurring and adapted to the momentary noise value in the telephone channel, being followed in a predetermined and defined way. Via the choice of the function of f(N) the subjective impression of the overall signal produced can also be adapted. Another advantage of this method variant is that in the case of a bundle of telephone channels, for example between international communication stations, the noise situation in each individual channel, which may very well be quite different from one channel to the next, can be automatically adjusted and optimised individually.

Particularly preferred is a variant of the method according to the invention characterised in that the predetermined function f(N) is a function g(S/N), which depends on the quotient S/N of the power value of the signal level S of the useful signals to be transmitted and the power value of the noise level N, or that the predetermined function f(N) is a function g'(N/S), which depends on the reciprocal of said quotient. For reasons of simpler practical realisation, a function of (S+N)/N or (S+N)/S can also be used.

The advantage of the above method variant is that if the useful signal level S in the telephone channels of a bundle is varying markedly, the correct adjustment for noise reduction will always be found. If the noise attenuation is controlled proportionally to the reciprocal N/S, the function g'(N/S) can easily be implemented on a digital signal processor (=DSP) with fixed computer word lengths for example of 16 bits using particularly simple software, since for N/S a numerical range 0<N/S<1 is mainly relevant or of interest for controlling the noise reduction.

Acoustic listening tests have shown that with S/N=0 dB speech is clearly so distorted that the noise may only be reduced by a value $f_o$ or $g_o$ between 5 and 10 dB, preferably between 6 and 8 dB, to a limited extent if degradation of the overall acoustic impression in relation to natural-sounding speech is to be avoided. At even less favourable values of the signal-to-noise ratio S/N<0 dB, the value $f_o$ or $g_o$ can be retained since any further noise reduction only worsens the overall impression.

According to these investigations, at mean S/N values the noise reduction can be more pronounced. In this, there is a maximum in the range 10 to 15 dB. The value of the noise attenuation $f_{max}$ or $g_{max}$ should amount at the maximum to between 20 and 30, preferably about 25 dB.

With very good noise values such that S/N>40 dB, only a minimal reduction between 0 and 3 dB should be effected so that the naturalness of the speech transmitted is kept as good as possible.

The sound of the speech and its understandability are particularly good when the function f(N) or g(S/N) is coherent in a continuous way beyond the three ranges discussed above, whereby rapid changes in N or in S(N) can be smoothed by filtering.

This is relatively simple to realise in terms of hardware and/or software, since the functions f(N) or g(S/N) or g'(N/S) are approximated by straight characteristic line sections between the three aforesaid operating points (sectional linear approximation).

In a somewhat more elaborate variant of the method according to the invention, but one whose result is a better sound picture, a polynomial function is used to implement the continuous functions f(N) or g(S/N) or g'(N/S) in the three ranges discussed, which as a result leads to a type of skewed bell function.

Especially preferable is a variant of the method according to the invention in that the functions f(N) and g(S/N) or g'(N/S) are chosen such that the reduction of the noise level N is aurally compensated in accordance with the psychoacoustic mean value of the spectrum audible by the human ear. In this, the value for S and/or N is determined not solely from the momentary power, but also from a weighted spectral variation of S or N respectively, and overall via the function so obtained a noise reduction appropriate for audition, i.e. one which sounds psycho-acoustically pleasant, is achieved. Since there is no simple measure for a noise reduction that sounds acoustically pleasant, all the quality assessments in extensive listening tests are taken into account and subsequently evaluated by statistical methods optimised for the purpose, in order to obtain an evaluation scale (similarly to the case of speech codecs).

Good noise level estimation necessitates a good silence interval detector, since only then can one be sure that in the silence intervals only distorting noise is present without any mixing at all between noise and snatches of speech, as is often the case in practice.

For that reason a method variant is especially to be preferred which is characterised in that in a silence detector (SPD), a short-time output signal sam(x), a medium-time output signal mam(x), and a long-time output signal lam(x) are formed by means of a short-time level estimator, a medium-time level estimator, and a long-time level estimator, respectively, that the three output signals sam(x), mam (x), and lam(x) are so adjusted via suitable amplification coefficients that they are approximately equal in magnitude when the input signal x is a pure noise signal, with sam(x) <mam(x)<lam(x), that the three output signals sam(x), mam (x), and lam(x) are monitored by comparators, and that the presence of a speech signal as the input signal x is assumed when both sam(x) and mam(x) first become larger than lam(x), while the presence of a silence interval is assumed when thereafter sam(x) and/or mam(x) become smaller than lam(x).

With the help of this relatively simple type of formation of various mean values of the time signal, surprisingly good silence interval detection can already be achieved, which requires only very little computational effort.

A further development of this method variant provides that for silence interval estimation, the three output signals sam(x), mam(x), and lam(x) are fed to a neural network which was trained with a plurality of scenarios with different input signals x. A neuronal network can advantageously picture linear and non-linear relationships between a large number of input parameters and the desired output values. A prerequisite for this is that the neuronal network has first been trained with a sufficient quantity of input values and associated output values. Thus, neuronal networks are particularly well suited for the task of silence interval detection in the presence of various kinds of distorting noise.

Preferably, besides the recognition and reduction of noise signals, the presence of echo signals will also be detected and/or predicted and the corresponding echo signals suppressed or attenuated. When in a telephone channel echoes occur in addition to noise, these can as a rule be predicted by virtue of a previously determined signal persistence time $\tau_E$ of an echo and the previously determined echo coupling ERL in the channel and the signal strength ES that triggers the echo in the return channel. This estimation can be carried out in such a way that as a function of the speech signal emitted and its momentary power, the size of the delayed echo is estimated. If the echo signal estimated in each case exceeds a predetermined threshold value thrs within determined short time segments, this echo-affected signal is preferably additionally damped for a short time, for example by means of the above-mentioned exponential attenuation, to a value necessary for an essential reduction of the echo signal. In the same sense, when echoes are present a compander characteristic curve can for a short time be displaced in the direction of greater input loudness and, once the echo has died away, it can be moved back to its original position.

Especially preferred is a further development of this method variant in that the control signal $a_0(k+1)$ is continuously adjusted according to $a_0(k+1)=h(N, S, ES, \tau_E, ERL)$, where $h(N, S, ES, \tau_E, ERL)$ is a predetermined function of the noise level N, the signal level S, the useful signal ES in the opposite direction from a speaking party, the constant delay $\tau_E$ of the echo signal, and an attenuation constant ERL of the amplitude of the echo signal.

Advantageously, a noise reduction appropriate for audition can be combined with an echo reduction independent of it. This is particularly important when there is virtually no background noise in the telephone channel, since there is then no noise attenuation and echo signals that occur can therefore reach the caller unimpeded.

Separation of the control of noise reduction from that of echo attenuation is appropriate, since noise and echoes occur independently of one another and are also typically caused by completely different physical effects. However, a general reduction function R can be generated mathematically, which describes an attenuation of signal levels for both noise and echoes:

$$R(S, N, ES, \tau_E, ERL, thrs) \sim g(S/N).d(ES, \tau_E, ERL, thrs)$$

in which g(S/N) is the noise reduction described earlier and d( . . . ) denotes the independent additionally occurring echo attenuation when the estimated echo signal exceeds the predetermined threshold value thrs.

Particularly advantageous is a method variant in which during the time of an echo reduction, an artificial noise signal is added to the useful signal.

At constant noise level, a noise attenuation is also constant. A suddenly occurring additional echo reduction in the speech rhythm means that there will also be a noise attenuation in the speech rhythm (at least in the short time segment). This leads to pulsed background noise which does not sound natural. It is therefore advantageous, at the instants when additional echo reduction takes place, to add to the processed signal a synthetic noise from a suitable noise generator of about the same magnitude as normal background noise. This results in background noise for the listener which is as constant as possible.

The noise generator can be designed such that the artificial noise signal comprises an acoustic signal sequence psycho-acoustically perceived as pleasant (=comfort noise).

Instead of synthetic background noise, however, a section of previously occurring real background noise of appropriate strength can be introduced during the echo-time segments. The added noise is then virtually no different from the previous noise and therefore results in no distorting acoustical variation for the listener.

The addition of noise to the acoustic masking of effects and the measures for separate treatment of noise and echoes, when these are correctly matched to one another, result in a particularly understandable and pleasant speech impression even in "difficult" environments (echoes plus noise).

Particularly preferable is also a variant of the method according to the invention, in which the useful signal to be transmitted is subjected to a spectral subtraction. The advantage of spectral subtraction with subsequent level attenuation during the speech pauses is that first, by spectral subtraction, part of the distorting noise is eliminated from the speech signal itself, and only after this are the speech pauses freed from noise and echoes in the manner described. Overall, in subjective tests this combination gives better listening impressions than simple spectral subtraction alone.

Finally, a further particularly advantageous variant of the method according to the invention provides that the useful signal to be transmitted is subjected to spectral filtering adapted to the sense of human hearing. Here too, with the means of spectral subtraction an estimate of noise, speech and echoes is first carried out, a masking threshold appropriate for audition is then determined, and the whole signal is then processed via an appropriately adjusted transmission filter such that the speech fraction is as undistorted as possible and the echo and noise fractions are suppressed to as large an extent as possible.

A combination with the subsequent level attenuation during silence intervals improves the listening impression still further.

The scope of the present invention also includes a server unit to support the method according to the invention described above, and a computer program for implementing the method. The method can be realised both as hardware circuit and in the form of a computer program. Nowadays software programming for a powerful DSP is preferred, because new knowledge and additional functions can be implemented more easily by modifying the software on an existing hardware basis. However, processes can also be implemented as hardware modules, for example in TK terminals or telephones.

Further advantages of the invention emerge from the description and figures. Likewise, the characteristics mentioned earlier and any indicated in what follows can in each case be applied individually as such, or several together in any combinations. The embodiments indicated and described are not to be understood as exclusive, but rather, as examples which illustrate the invention.

The control signal $a_o$ shown in FIG. 1 as a function of time t and sample number k is kept at a value $c_o$=1 during a first phase T1 in which speech signals are detected. During a silence interval in the time segment T2 the control signal $a_o$ is reduced to a constant value $c_2$ slightly above 0, and then, when the speech signal resumes during a phase T3, it is sharply increased again to the value $c_o$=1 (or to some other, freely selectable constant). Consequently, during the speech phases T1, T3 there is no (or in other examples only a slight) suppression of distorting signals in the overall signal, so that the speech signal is transmitted as unmodified and as unimpeded as possible. During the silence interval in phase T2, the most effective suppression of echoes and noise signals is implemented as quickly as possible (exponentially), although in the present example these are attenuated not to 0 but to a small residual value $c_2$, to avoid creating the impression of a "dead" line at the other end. When echoes occur, attenuation takes place down to a residual value of $$c_3 < c_2$$

Figure 2:
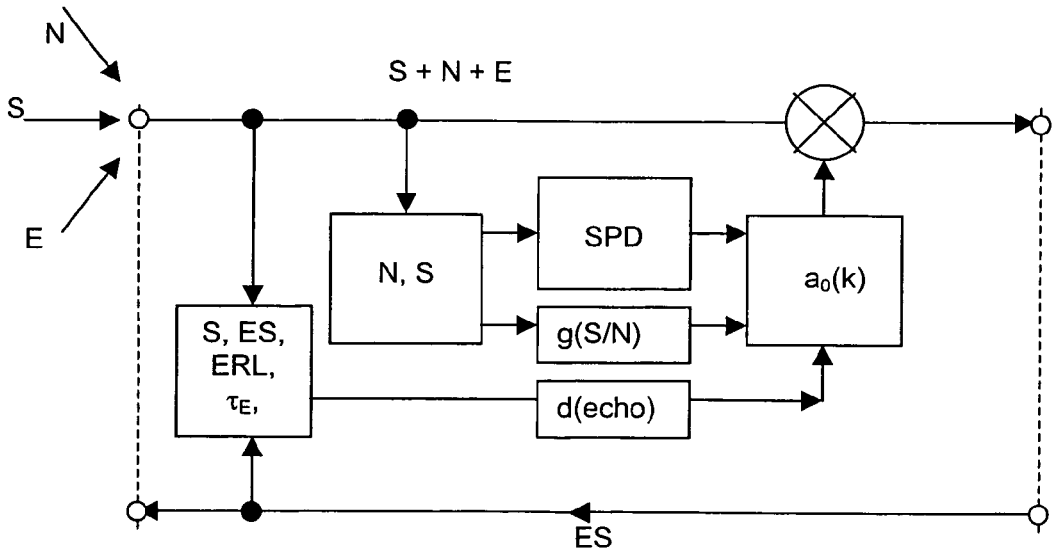
FIG. 2 shows a scheme of an arrangement for controlled signal attenuation.
Figure 3A:
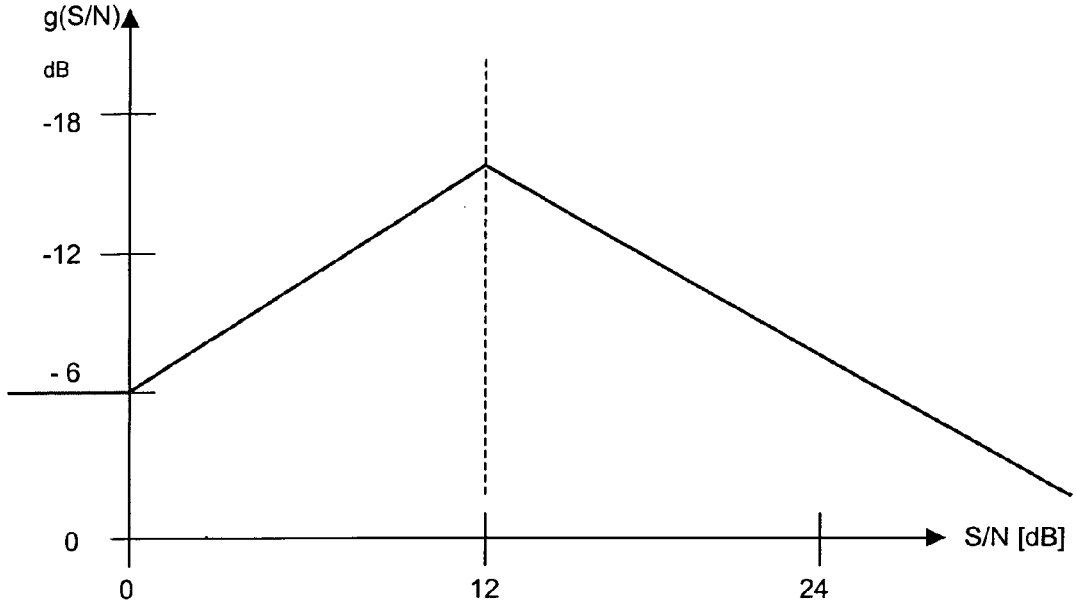
FIG. 3*a* shows the function g(S/N) in linear approximation.
Figure 3B:
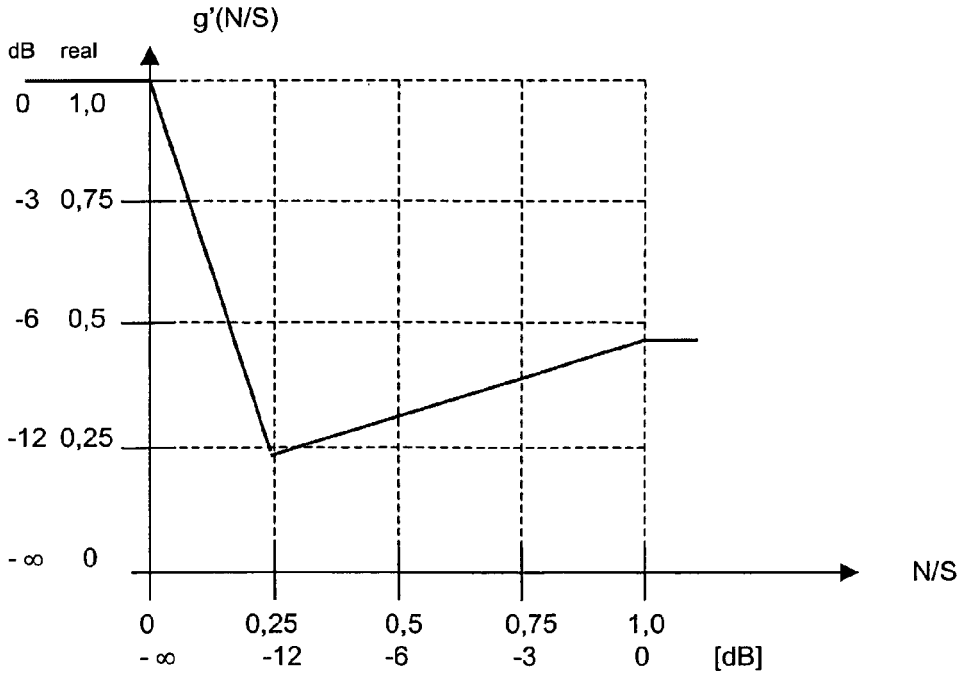
FIG. 3*b* shows the corresponding function g'(N/S)
Figure 4A:
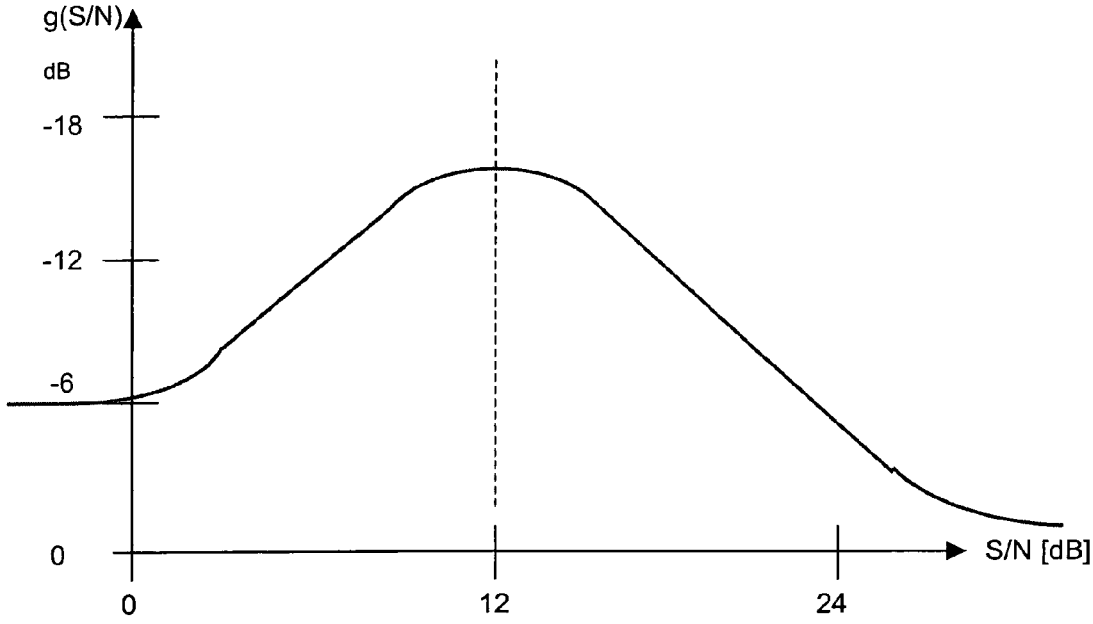
FIG. 4*a* shows the function g(S/N) as a skewed bell curve.
Figure 4B:
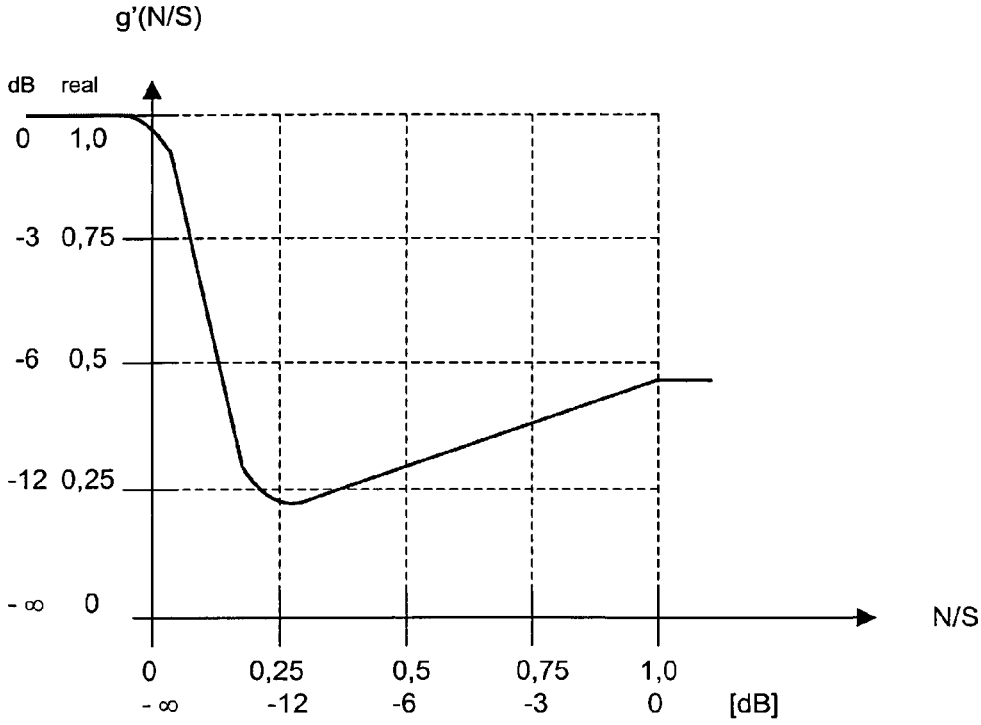
FIG. 4*b* shows the corresponding function g'(N/S).

FIG. 2 illustrates schematically the functional mode of an arrangement for noise and echo reduction with a silence interval detector, corresponding to the above-mentioned reduction function R(S, N, ES, $\tau_E$, ERL, thrs).

For all the curves shown in FIGS. 3*a* to 4*b*, the function value g or g' for the case in which S/N<0 dB, i.e. when the noise background is extremely high, changes to a constant value $g_o$ of the noise reduction equal to approximately 6 dB. Starting from S/N=0 dB, as the signal-to-noise ratio S/N improves progressively, increased noise reduction takes place up to a maximum $g_{max}$~25 dB at approximately S/N 12 dB. If S/N increases further, the degree of noise reduction finally falls towards zero so that when little background noise is present, as little manipulation of the useful signal transmitted will take place.

What is claimed is:

1. A method of reducing at least one of echo and noise signals in telecommunications systems for transmitting useful acoustic signals, comprising:

determining by silence detection when a mixture of useful signals and interference signals contains a speech signal or when a silence interval is present; and varying, by means of a two-input multiplier, the amplitude of the useful signals, which are generally disturbed by the at least one of echo and noise signals, in response to a time-dependent control signal $a_0(t)$ or a control signal $a_0(k)$ clocked at a sampling rate $f_T=1/T$, where $k \in \aleph$ denotes the number of samples, and T denotes the period from one sample to the next, wherein the control signal $a_0(t)$ or $a_0(k)$ is varied in such a way that, in the presence of speech signals in the useful signals, the amplitude of the control signal $a_0(t)$ or $a_0(k)$ is set to a predetermined constant value $c_0$, wherein, from the beginning of a silence interval in the useful signal, the amplitude of the control signal $a_0(t)$ or $a_0(k)$ is continuously reduced from one sample to the next according to the recursion formula $$a_0(k+1)=a_0(k)\cdot\beta, \text{ where } \beta<1,$$

and wherein, after the end of a silence interval, $a_0(k)$ is set equal to $c_0$.

2. The method as claimed in claim 1, wherein the factor $\beta$ is determined from the sampling rate $f_T$, a time constant $\tau_1$, and a predefined constant factor $c_1$ according to the relation $$\beta=c_1\cdot\exp(-1/\tau_1 f_T).$$

3. The method as claimed in claim 2, wherein the time constant $\tau_1$ is between 50 ms and 150 ms.

4. The method as claimed in claim 3, wherein the time constant $\tau_1\approx 65$ ms.

5. The method as claimed in claim 1, wherein the constant value $c_0$ is equal to 1.

6. The method as claimed in claim 1, wherein, at least one of during a silence interval and in the presence of an echo signals, $a_0(k+1)$ assumes a predefined constant value $c_2$ if the preceding value $a_0(k)$ has become less than or equal to $c_2$.

7. The method as claimed in claim 1, wherein, at least one of during a silence interval and in the presence of an echo signal, and for $a_0(k)\leqq c_2$, where $c_2$ is a predefined constant, a power value of a noise level N in a communications channel currently being used is at least one of continuously measured and estimated, and wherein, depending on the current noise level N, the control signal $a_0(k+1)$ is continuously adjusted according to $a_0(k+1)=f(N)$, where f(N) is a predetermined function of N.

8. The method as claimed in claim 7, wherein the predetermined function f(N) is a function g(S/N), which depends on a quotient S/N of a power value of a signal level S of the useful signals to be transmitted and the power value of the noise level N, or the predetermined function f(N) is a function g'(N/S), which depends on the reciprocal of said quotient.

9. A method as claimed in claim 8, wherein, if 1N<<1 or S/N=0 dB, the function f(N) or g(S/N), which begins with a constant value $f_0>0$ or $g_0>0$, respectively, rises to a maximum $f_{max}$ or $g_{max}$ in the range between N or S/N=10 dB to 15 dB, respectively, and then decreases to a minimum value $f_{min}$ or $g_{min}$, respectively, which is substantially 0 dB, respectively.

10. The method as claimed in claim 9, wherein $f_0>5$ dB and $g_0<10$ dB.

11. The method as claimed in claim 9, wherein $f_0\geqq 6$ dB and $g_0\leqq 8$ dB.

12. The method as claimed in claim 9, wherein $f_{max}\geqq 20$ dB and $g_{max}\leqq 30$ dB.

13. The method as claimed in claim 9, wherein $f_{max}\approx 25$ dB and $g_{max}\approx 25$ dB.

14. The method as claimed in claim 9, wherein the constant value $f_0>0$ or $g_0>0$, respectively, rises to a maximum $f_{max}$ or $g_{max}$ in the range between N or S/N≈12 dB, respectively.

15. The method as claimed in claim 7, wherein the function f(N) or g(S/N) is linear in at least one section, respectively.

16. The method as claimed in claim 15, wherein the function f(N) or g(S/N) is linear in all its sections, respectively.

17. The method as claimed in claim 7, wherein the function f(N) or g(S/N) consists of polynomials represented by a skewed bell-shaped curve.

18. The method as claimed in claim 7, wherein the functions f(N) and g(S/N) or g'(N/S) are chosen such that the reduction of the noise level N is aurally compensated in accordance with a psychoacoustic mean value of a spectrum audible by a human ear.

19. The method as claimed in claim 1, wherein, in addition to the detection and reduction of noise signals, the presence of echo signals is at least one of detected and predicted, and the echo signals are suppressed or reduced.

20. The method as claimed in claim 19, wherein, at least one of during a silence interval and in the presence of an echo signal and for $a_0(k)\leqq c_2$, where $c_2$ is a predefined constant, a power value of a noise level N in a communications channel currently being used is at least one of continuously measured and estimated, wherein, depending on the current noise level N, the control signal $a_0(k+1)$ is continuously adjusted according to $a_0(k+1)=f(N)$, where f(N) is a predetermined function of N, and wherein the control signal $a_0(k+1)$ is continuously adjusted according to $a_0(k+1)=h(N, S, ES, \tau_E, ERL)$, where $h(N, S, ES, \tau_E, ERL)$ is a predetermined function of the noise level N, a signal level S, a useful signal ES transmitted from a speaking party, the constant delay $\tau_E$ of the echo signal, and an attenuation constant ERL of the amplitude of the echo signal.

21. The method as claimed in claim 19, wherein the reduction of noise signals and the reduction of echo signals are controlled separately.

22. The method as claimed in claim 19, wherein, during the time of an echo reduction, an artificial noise signal is added to the useful signal.

23. The method as claimed in claim 22, wherein the artificial noise signal comprises an acoustic signal sequence perceived to be psychoacoustically pleasant.

24. The method as claimed in claim 22, wherein the artificial noise signal comprises a noise signal previously recorded during the current communication.

25. The method as claimed in claim 1, wherein, in a silence detector (SPD), a short-time output signal sam(x), a medium-time output signal mam(x), and a long-time output signal lam(x) are formed by means of a short-time level estimator, a medium-time level estimator, and a long-time level estimator, respectively, wherein the three output signals sam(x), mam(x), and lam(x) are so adjusted via suitable amplification coefficients that they are substantially equal in magnitude when an input signal x is a pure noise signal, with sam(x)<mam(x)<lam(x), wherein the three output signals sam(x), mam(x), and lam(x) are monitored by comparators, and wherein the presence of a speech signal as the input signal x is assumed when both sam(x) and mam(x) first become larger than lam(x), while the presence of a silence interval is assumed when thereafter at least one of sam(x) and mam(x) become smaller than lam(x).

26. The method as claimed in claim 25, wherein, for silence interval estimation, the three output signals sam(x), mam(x), and lam(x) are fed to a neural network which was trained with a plurality of scenarios with different input signals x.

27. The method as claimed in claim 1, wherein a useful signal to be transmitted is subjected to a spectral subtraction.

28. The method as claimed in claim 1, wherein a useful signal to be transmitted is subjected to spectral filtering adapted to a sense of human hearing.

29. A server unit for supporting the method claimed in claim 1.

30. A computer program for carrying out the method claimed in claim 1.

31. The method as claimed in claim 1, wherein the useful acoustic signals include human speech.

* * * * *